United States Patent [19]

Lynch

[11] Patent Number: 4,942,895

[45] Date of Patent: Jul. 24, 1990

[54] TENSIONED TENT STRUCTURE AND ERECTION METHOD THEREFOR

[76] Inventor: James P. Lynch, 13 S. Field, Lakewood, Colo. 80226

[21] Appl. No.: 268,852

[22] Filed: Nov. 9, 1988

[51] Int. Cl.[5] ..... E04H 15/00

[52] U.S. Cl. ..... 135/99; 135/114; 135/DIG. 8; 52/222

[58] Field of Search ..... 135/114, 99, 905, DIG. 5, 135/DIG. 8; 52/222

[56] References Cited

U.S. PATENT DOCUMENTS

| | | | |
|---|---|---|---|
| 34,603 | 3/1862 | Townsend | 135/99 |
| 2,001,196 | 5/1935 | Jost | 135/DIG. 5 |
| 3,161,990 | 12/1964 | Morris, Jr. | 135/114 |

FOREIGN PATENT DOCUMENTS

| | | | |
|---|---|---|---|
| 667876 | 10/1929 | France | 135/99 |
| 726646 | 3/1955 | United Kingdom | 135/99 |

*Primary Examiner*—Carl D. Friedman
*Assistant Examiner*—Caroline D. Dennison
*Attorney, Agent, or Firm*—Timothy J. Martin

[57] ABSTRACT

A tensioned tent structure includes a flexible covering having a vertex portion and spaced corner portions and which has a selected geometrical shape in the erect position. The tent structure further includes an anchor for securing each corner portion to the support surface and a pole assembly that supports the covering in an erect state with the vertex above the support surface. The pole assembly has an extension and contraction mechanism to vary its effective length to apply upward force to the vertex portion thus tensioning the covering to draw it taut. The broad method of the present invention thus contemplates the broad steps of providing such a flexible covering having a vertex and corner portions, securing the corner portions to the support surface, positioning a pole assembly in an upright position between the support surface and the vertex portion and forcibly expanding the pole assembly to tension the flexible covering in a taut condition. Preferably, the tent structure has a base perimeter in the shape of a regular polygon with the structure shaped generally as a pyramid. The covering is formed of fabric panels cut to enhance the effect of tensioning forces. The invention also contemplates tent structures having a plurality of center pole assemblies.

30 Claims, 5 Drawing Sheets

TENSIONED TENT STRUCTURE AND ERECTION METHOD THEREFOR

FIELD OF THE INVENTION

The present invention is directed to a tent structure erectable on a support surface such as the ground, paved areas and the like. The tent structure specifically relates to large area tents which may be conveniently stored in a relatively small space, but, when erected, provide a protected space adapted for concessions, merchandise displays, assemblies, to name a few uses. Thus, the present invention concerns itself with large area protective enclosures as opposed to small shade screens, camping tents and the like.

BACKGROUND OF THE INVENTION

The desirability of large area shelters has long been recognized, and many industries employ pavilion-like shelters to protect against the elements, such as sun, wind and rain. These tents are commonly used in commercial, fair, exhibit and party applications. One such example may be found in traveling shows and exhibits, such as merchandise exhibits, carnivals, and the like.

Historically, large area tents are believed to have been first used by traveling shows, such as traveling circuses which found it necessary to employ large area tents as a staging arena for the circus activities. Yet another example of the need for large scale tents was early recognized by the military with its need for large area tent structures which may be rapidly erected and disassembled. More recently, many car dealerships and other merchants have implemented temporary or permanently erected tent structures to provide additional space for their wares, such as automobiles, in order to protect their merchandise and to provide shelter for customers reviewing the merchant's goods. The need for large area tents has increasingly expanded into broader commercial and exhibit applications.

Despite the long felt need for large area tent structures, there has been surprisingly little development in the industry of large scale tents. The most prevalent example of such structures is the standard rectangular tent having one or more apex portions supported by central poles. The perimeter of the covering is supported by perimeter poles with the peripheral edge of the tent being staked by a plurality of spikes and guy ropes interconnect the perimeter to the spikes in order to tension the tent's covering after it is erected. Another example of the traditional large area tent is the circus tent wherein margins of the tent are preliminarily staked and center poles erected after which the apex portion of the tent is drawn up around the pole by means of pulleys. Block and tackles may then be employed to tension the tent against the stake elements.

More recently, though, there have been some efforts to create different tent structures which provide shelter and which are more aesthetically pleasing. These developments have, in part, stemmed from improvements in fabric technology, such as the development of lighter weight, stronger materials which more readily accept tension forces and which tend to better retain their shape under environmental conditions. However, even recent tent designs rely upon the old concept whereby corners of the tent covering are individually and sequentially stressed against a constant length, erected, center pole. As a result of this whole concept, even these improved tent structures, nevertheless, require a substantial period of time to erect and often require an entire crew of workers to accomplish the task. Accordingly, there has been a long-felt need for large scale tent structures which are not only aesthetically pleasing but which can be erected quickly and conveniently. There is a further need for such tent structures that can be disassembled quickly and stored in a compact space and easily transported.

SUMMARY OF THE INVENTION

It is an object of the present invention to provide a new and useful tent structure which is light-weight and can be erected by a single person in a minimum amount of time.

It is yet another object of the present invention to provide a light-weight, compact large area tent which can be easily erected and disassembled in a minimum amount of time.

It is yet a further object of the present invention to provide a tent structure formed of tensioned fabric wherein the tension is applied along the weave of the fabric without applying undue tension to the seams of fabric panels comprising the tent covering.

Another object of the present invention is to provide a tent se structure that may have its corners completely staked to a support surface after which tension is applied to the apex portion of the tent to uniformly and simultaneously tension the tent covering against its corners.

A still further object of the present invention is to provide a method covering a large surface area wherein a tent covering may be erected quickly and conveniently by a minimum crew by establishing all corner location stakes and all center pole locations prior to securing a tent covering thereto.

In its broad form, the tensioned fabric tent structure according to the present invention is adapted to be erected on a support surface to provide a sheltered space. The tent structure includes a flexible covering as a vertex portion in a plurality of corner portions spaced apart from the vertex portion with the flexible covering configured in a selected geometrical shape. A plurality of anchors, preferably in the form of anchor plates and spikes, are provided to secure each corner portion to the support surface. A center pole assembly is provided to be positioned between the support surface and the vertex portion so as to have an effective length that supports the covering in an erected state with the vertex portion spaced above the support surface. The center pole assembly may be expanded and contracted while in an erect state to adjustably vary its effective length causing the vertex portion to move further away from and closer to the support surface. Thus, with the pole assembly in erect position, tension forces can be increased and decreased between the vertex portion and the corner portions when they are anchored to the anchor elements. When tension is applied, the tension is uniformly distributed simultaneously to the corner members thus holding the covering in a taut condition.

Preferably, the covering is generally in the shape of a pyramid having a polygonal base whose vertices are defined by the corner portions of the covering. This covering is made of a plurality of panel sections which form a base of the pyramid with edges of the panel section being secured to one another along attachment seams to define primary radial lines extending between the vertex and a corner portion. Reinforcement webbing strips may then be attached along the primary attachment seams between adjacent panels so that tension forces are received by these reinforcement webbing strips. Each panel section may, in turn, be formed by triangular panel pieces which are cut in one direction parallel to the warp of the fabric with the remaining cuts being a bias cut and a swarf cut so that the triangular panel piece is stretchable in a direction laterally of the warp cut edge. This allows the covering to be maintained in a taut condition when tension forces are applied. Archways may be formed between corner portions to allow ingress and egress into and out of the shelter space and, if desired, the archways may be provided with screen panels to further enclose the space confined by the tent structure.

In the preferred embodiment, the center pole is formed of a plurality of pole sections which are longitudinally mountable to one another in an end-to-end relation. Preferably, one of the pole sections includes a pair of telescoping members which are interconnected by a rack gear and a gear drive so that they may be forcibly driven apart to extend the effective lengths of the assembled pole. This pole structure may have a pole mounting element in the form of a flat plate which engages the support surface and is staked thereto. This pole mounting element has a pole receiving cup extending upwardly therefrom to receive a lower portion of the pole assembly. An upper portion of the pole assembly terminates in a crown, which may be rotatably mounted on the pole assembly with this crown having notches operative to engage a spider wheel to which the vertex portion of the covering is mounted.

Each anchor plate includes a portion which engages the support surface and spikes may secure the plate to the support surface. Each corner portion of the covering terminates in a reverse curve flap, which may be reinforced by a plastic panel, and a fastener is secured by the reverse folded corner flap. This fastener then may engage the anchor plate in a quick release manner. The covering may also include a plurality of vertex portions which receive a plurality of pole assemblies, to increase the size of the space protected by the tent structure.

In the broad method according to the present invention is a method for sheltering a surface area on a support surface bounded by a perimeter. This broad method includes the steps of providing a flexible covering which has a vertex portion and a plurality of corner portions spaced from the vertex portion; anchoring each corner portion to the support surface at locations along the perimeter to be sheltered; positioning a pole assembly in an upright orientation between the support surface and the vertex portion to hold the vertex portion of the support surface; and forcibly expanding the length of the pole assembly to apply an upward force against the vertex portion thus moving the vertex portion away from the support surface to simultaneously create tension between the vertex portion and each respective anchored corner portion thereby drawing the covering in a taut condition. With this method, the center pole position can first be established and each corner portion can be located prior to attachment of the covering thereto. Preferably, the covering has end corner portions and is generally in the shape of a pyramid when the covering is in the taut condition with the pyramid having a base in the shape of a regular polygon having end sides such that there is a radial distance r between the corner portion of the polygon vertex to the center of the polygon (wherein n is a positive integer then or equal to 3). The corner locations are thus found by measuring the distance r radially outwardly from the center to locate a first anchor point and thereafter locating successive anchor points by determining a location that is simultaneously a distance r from the center and a distance (2 r) sin (180°/n) from a previously located anchor point. This may be accomplished by providing a flexible measuring cord having two sections of appropriate length to accomplish this measurement.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention provides the tensioned tent structure that is particularly adapted to cover relatively large surface areas so as to enclose a sheltered space. This tent structure is particularly useful as a quick erect shelter which may be erected easily by a single person in a minimum amount of time. Correspondingly, it may be quickly disassembled, or taken down, and stored in a light-weight package in a minimum amount of space.

Figure 1:
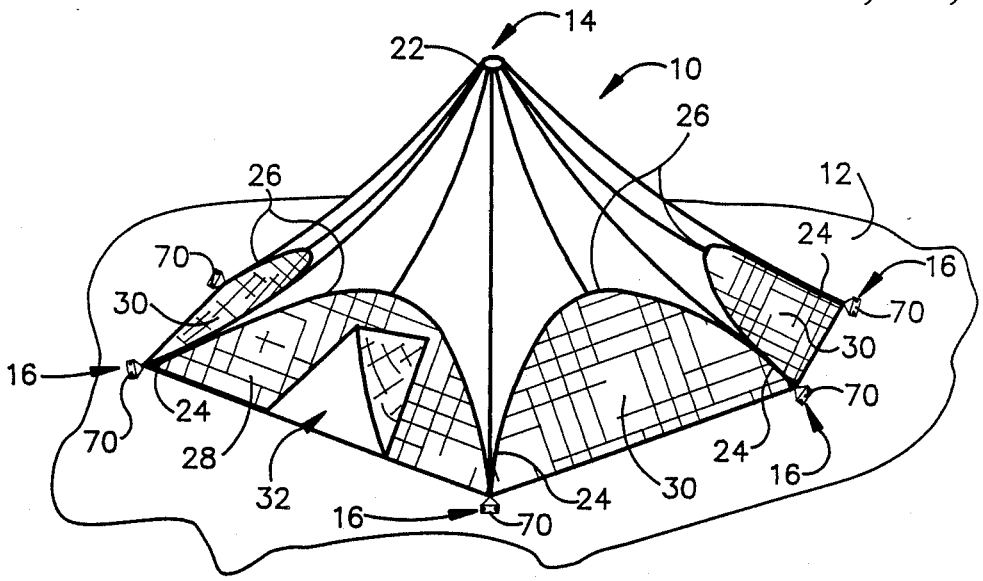
FIG. 1 is a perspective view of a tension fabric tent structure according to the preferred embodiment of the present invention shown in an erect state on a support surface.

As is shown in FIG. 1, tension tent structure 10 is shown mounted on a support surface 12 which may be conveniently the ground, paved surface or other area which is desired to be sheltered. Tent structure 10 is generally pyramidal in shape having a vertex 14 and a plurality of corners 16 which define vertices for a generally polygonal base of the pyramid although any selected geometric base is contemplated by the present invention. Tent structure 10 is broadly formed by a flexible covering 20, a plurality of anchor members 70 and a pole assembly 100 (not shown in FIG. 1).

Flexible covering 20 is preferably constructed of urethane backed polyester fabric that is treated to be fire retardant and resistant to ultraviolet breakdown. Covering 20 includes a vertex portion 22 and a plurality of corner portions 24 which are adjacent each corner 16. An arcuate tension seam 26 extends between each pair of adjacent corner portions 24 to form archways, at least one of which is sized to allow ingress into and egress out of the sheltered space. If desired, screen panels, such as panels 28 and 30 may be permanently or releasably affixed between each adjacent corner 24 and their associated arcuate tension seam 26 and extend downwardly to the support surface. For example, in FIG. 1, side panel 28 includes a doorway 32, of a type standard in the tent industry, while each side panel 30 provides a screen. Side panels 28 and 30 may be of any suitable fabric, clear vinyl window material, mosquito netting, and the like. If desired, the screen panels may be coated with materials, as is known in the art, to restrict view into the space with restricting view out of the space; one such screen, for example, is mirrored vinyl.

Figure 2:
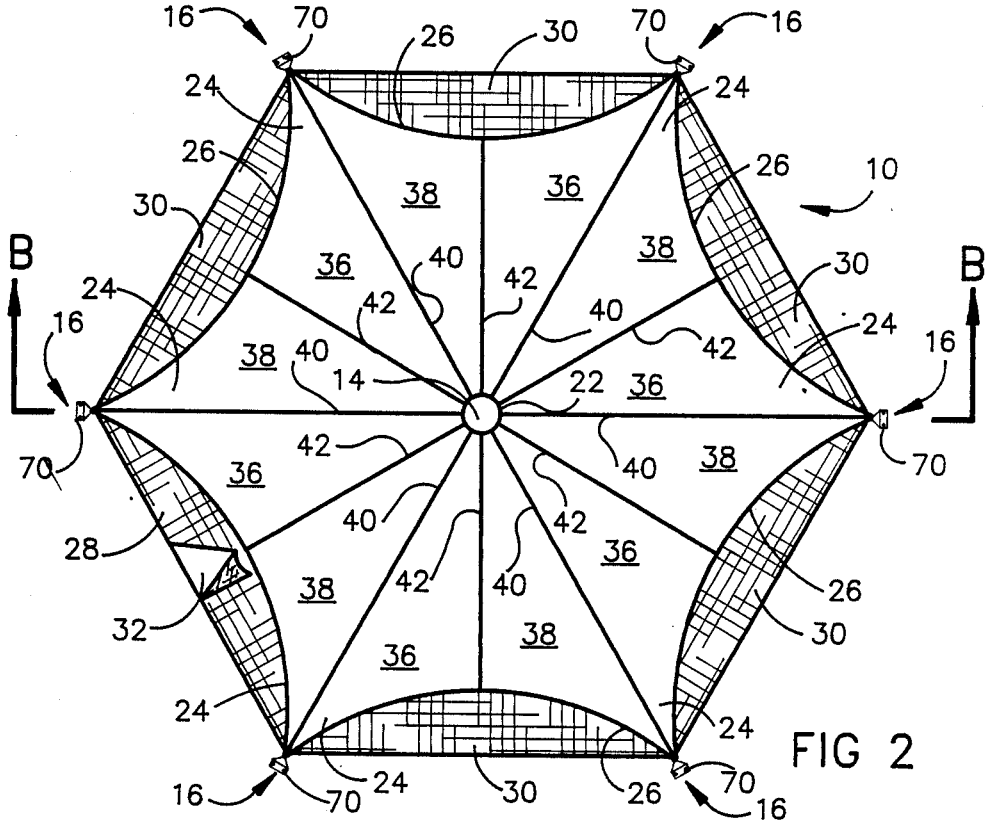
FIG. 2 is a top plan view of the tent structure shown in FIG. 1.

As is shown in FIG. 2, tent structure 10, in the preferred embodiment, has a polygonal base that is in the form of a regular hexagon, having six corners 16 and, correspondingly, six corner portions 24. A respective anchor member 70, described in greater detail below, secures each corner portion 24 to the support surface. Each side of tent structure 10, between two adjacent corners 16, is constructed of a panel section 34 which, in turn, is formed by a pair of panel pieces 36 and 38 connected together along secondary attachment seams 42. Each pair of side panel section forming panel pieces 36 and 38 are connected to an adjacent panel section along a primary attachment seam 40 with primary attachment seams 40 defining equiangularly spaced radial lines extending between vertex 14 and corners 16. Accordingly, it should be appreciated that each panel section 34 has a pair of side edges along primary attachment seams 40 and a base edge along tension seam 26 with these base edges forming a peripheral edge for flexible covering 20. Each panel piece 36 and 38 is thus in the shape of a triangle, as described more fully below. Each pair of panel pieces 36 and 38 which form a panel section 34 are symmetric with respect to one another about secondary attachment seam 42. Likewise, each adjacent panel piece 36 and 38 of adjacent panel sections are symmetric about the primary attachment seam 40.

Figure 3:
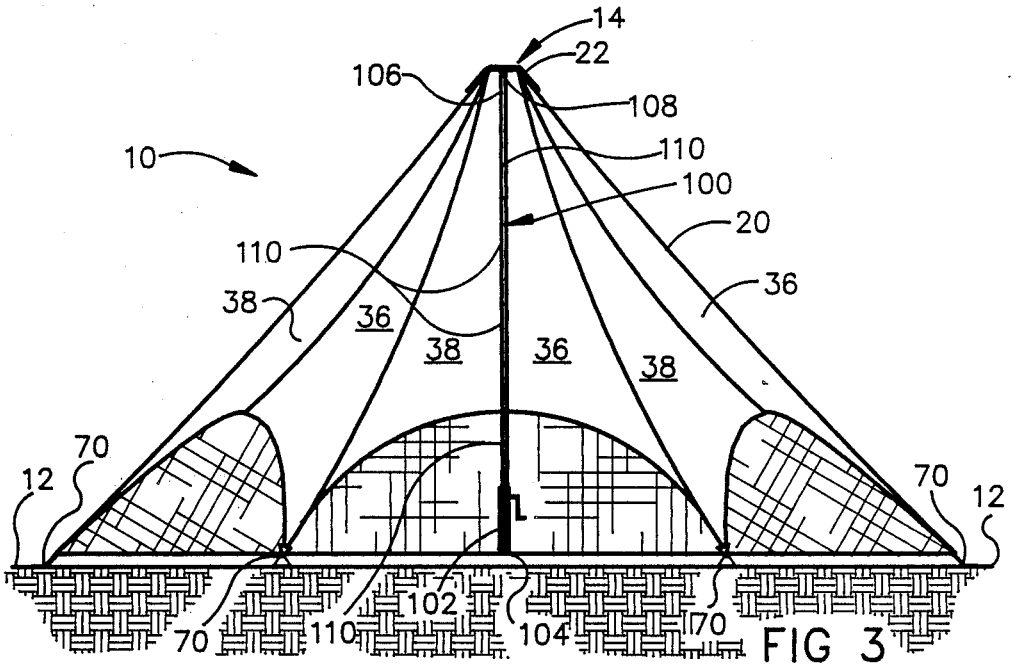
FIG. 3 is a cross-sectional view taken about Lines 3—3 of FIG. 2.

FIG. 3 shows a cross-sectional view of tent structure 10, and it may now be appreciated that pole assembly 100 is positionable in an upright position between support surface 12 and vertex portion 22 and has an effective length which supports covering 20 in an erect state (shown in FIGS. 1 and 3) so that vertex portion 22 is spaced above the support surface. As described more thoroughly below, pole assembly 100 includes extension and contraction means in the form of a jack assembly 102 which has a base 104 which rests on or engages support surface 12. An upper end 106 of pole assembly 100, opposite base 104, engages a vertex portion 22 of covering 20. Jack assembly 102 is adjustable to vary the effective length of pole assembly 100 in order to move vertex portion 22 further from and closer to support surface 12 when pole assembly 100 is in the upright position shown in FIG. 3. When anchor members 70 firmly secure corner portions 24 of covering 20 to support surface 12, extension of pole assembly 100 simultaneously increases tension forces between vertex portion 22 and each corner portion 24 thereby moving covering 20 and holding covering 20 in a taut condition. Contraction of jack assembly 102 correspondingly reduces the effective length of pole assembly 100 thereby allowing vertex portion 22 to move closer to the support surface 12 to decrease these tension forces between vertex portion 22 and each corner portion 24.

As may be appreciated, the tension force between the vertex portion and each respective corner portion is along a primary radial line extending therebetween and which is formed by primary attachment seam 40. With the construction of panel pieces 36 and 38, as well as tension seams 26, tension is also applied along secondary radial lines extending from vertex portion 22 to the peripheral edge of covering 20 as defined by the respective tension seams 26. Thus, the tension along the secondary radial lines is borne, in the preferred embodiment, by second attachment seams 42, each of which extends between a central portion of a respective tension seam 26 and vertex portion 22.

Figure 4:
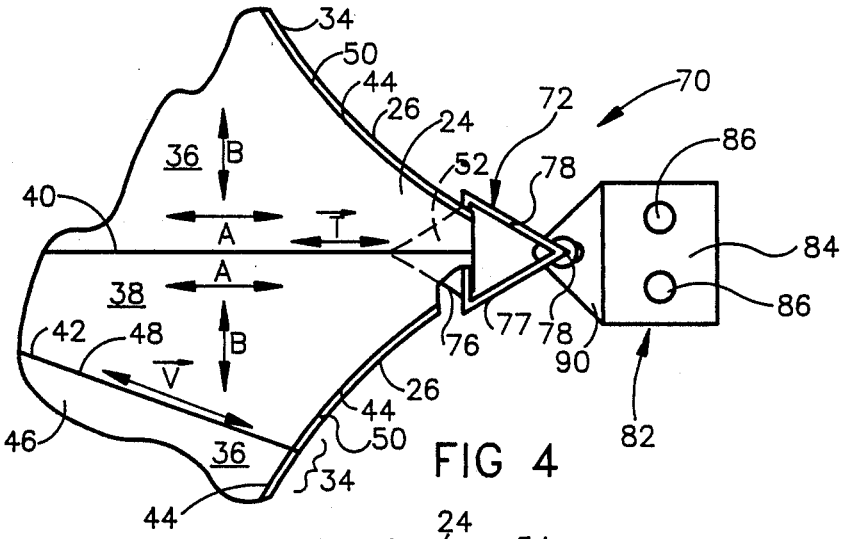
FIG. 4 is an enlarged view of a corner section of the covering assembly of the tension fabric tent support structure of the present invention showing the corner portion in an anchored state.

Preferably, covering 20 is constructed of a woven fabric material having warp threads and weft threads. As is best shown in FIG. 4, a first pair of panel pieces 36 and 38 form a side panel 34 which is secured to a second side panel 34' along primary attachment seam 40. Thus, panel piece 38 of side panel 34 is connected to panel piece 36' of side panel 34' along this primary attachment seam 40 while panel piece 36 is connected to panel piece 38 along secondary attachment seam 42. The corner portion 24 formed by side panels 34 and 34' is attached to a corner retaining element 72 which is releasably secured to anchor plate 82 with corner retaining elements 72 and anchor plate 82 forming a respective anchor member 70.

As noted above, panel pieces 36' and 38 are symmetric about primary attachment seam 40 and, where formed of woven fabric, it is preferred that either the warp threads or the weft threads are oriented parallel to the primary attachment seam 40. In the preferred embodiment, though, as is shown in FIG. 4, panel section 36' and panel section 38 each have warp threads which run in the direction of arrows "A" and correspondingly have weft threads running in the direction of arrows "B". Accordingly, base edges 44 and 44' are bias cut to allow some stretching while edges 46 and 48 of a side panel forming panel pieces 36 and 38 are swarf-cut and are attached by secondary attachment seams 42. Accordingly, the primary tension between each corner portion 24 and the vertex portion 22, as represented by vector $\vec{T}$ in FIG. 4 is borne by primary attachment seam 40 and the warp threads of panel pieces 36' and 38. Thus, primary tension is along the warp threads which reduces stress on seam 40. Secondary tension in the direction of $\vec{V}$ is borne by secondary attachment seam 42. However, due to the bias cut and swarf cuts, the tension of $\overline{V}$ will tend to cause a skewing or stretching of the fabric panel between its primary attachment seam 40 and its secondary attachment seam 42 thus always maintaining the panel piece in a taut condition when tension is applied to the covering. Tension seams 26 are thus provided along complimentary pairs of bias cut edges 44 and may be sewn with a reinforcement webbing 50. Similarly, primary attachment seam 40 may include a reinforcement webbing 41 and secondary attachment seam 42 may include reinforcement webbing 43, both as is shown with respect to FIGS. 8 and 9, described below.

Figure 5:
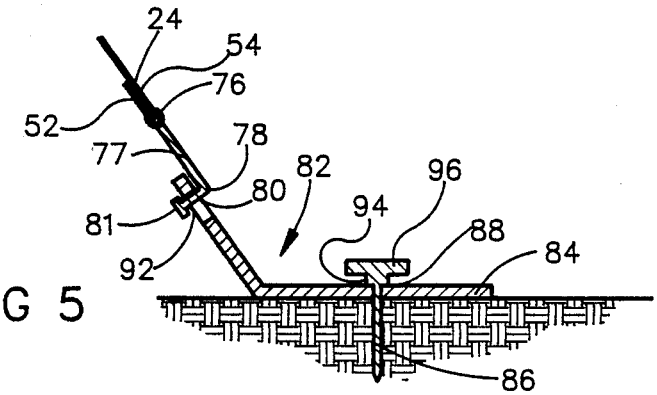
FIG. 5 is a cross-sectional view showing the anchoring arrangement of a corner portion of the tent structure according to the preferred embodiment of the present invention.

As noted above, corner portion 24 mounts a corner retaining element 72. Corner retaining element 72 has a triangular piece 74 formed of a metal rod so that it has a base rod 76 and a pair of side rods 77 which are attached to one another at nose 78. As is shown in FIG. 5, base rod 76 is secured at corner portion 24 by a reverse folded corner flap 52 which is folded around base rod 76 and affixed to itself by means of stitching or other convenient attachment technique to form a sleeve that receives base rod 76. Preferably, a reinforcement insert 54 is provided for strength, with insert 54 preferably being a triangular plastic sheet that wraps around rod 76 and is folded and secured with flap 52.

Corner retaining element 52 includes a lateral arm 80 which projects away from nose 78 and which terminates in a flattened head 81. Anchor plate 82 includes a base plate 84 which may be staked to support surface 12 by means of a plurality of stakes 86 which may extend through holes, such as hole 88 in base plate 84. An angled plate portion 90 is generally triangular in shape and extends at an obtuse angle with respect to base plate 84 as an integral extension thereof. Plate portion 90 includes an opening 92 which is sized to be slightly larger than head 81 of retaining element 72. Thus, as is shown in FIG. 5, head 81 may be inserted through opening 92 and retained by plate portion 90 when tension is applied to covering 20. This structure allows quick connect and release of each corner portion to its anchor means. Each stake 86 includes an intermediate shank 94 and an enlarged head 96. Shank 94 is sized so that it will not pass through hole 88 so that enlarged head 96 will be proximate base plate 84 but spaced therefrom to allow insertion of a prying tool to remove stake 86.

As noted above, tension tent structure 10 includes a pole assembly which is positionable in an upright position between support surface 12 and vertex portion 22 of flexible covering 20. This pole assembly 100 may be more further understood with reference to FIGS. 3, 6, 7 and 9. In FIG. 3, it may be seen that pole assembly 100 includes a jack assembly 102, base 104, crown piece 108 and a plurality of pole sections 110.

Figure 6:
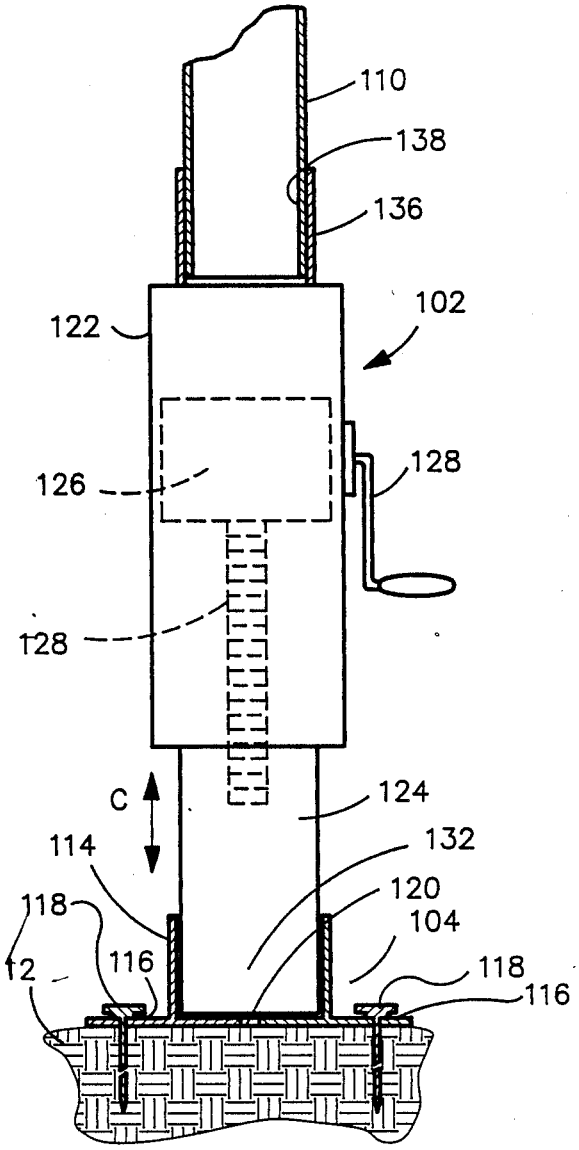
FIG. 6 is a side view and partial cross-section of a center pole assembly according to the preferred embodiment of the present invention showing an expansion and contraction means in the form of a common jack assembly.

As is shown in FIG. 6, base 104 includes a flat plate 112 and an upwardly extending boss 114 in the form of a cylindrical cup. Flat plate 112 includes a plurality of holes 116 through which stakes 118 may be driven to mount base 104 to support surface 12. Stakes 118 are similar in construction to stakes 86, described above. A drain hole 120 is also provided in flat plate 112 to allow water to drain out of socket forming boss 114.

Jack assembly 102 is of a type commonly known in the art such as those used to elevate and support tongues of trailer assemblies. Of course, jack assembly 102 could take many different forms, as the ordinarily skilled person in the art will recognize, and include hydraulic jack mechanisms, screw jack mechanisms and the like. It is merely required, for purposes of the invention, that jack assembly 102 be sufficient to expand and contract so as to vary the effective length of pole assembly 100. As noted, though, in the preferred embodiment of the present invention jack assembly 102 includes a central cylindrical member 122 which telescopically receives extension tube 124 so that tube 124 may move into and out of member 122 in the direction of arrow "C". As is known in the art, member 122 can contain a locking gear drive assembly 126 (shown in phantom) which may be manually operated by crank 128. Gear drive assembly 126 engages a rack gear 130 (also shown in phantom) so that operation of crank 128 operates to extend and contract extension tube 124. End 132 of extension tube 124 is sized to mate with boss 114, and an upper end 134 of jack assembly 102 includes a boss 136 that defines a cylindrical cup operative to receive a free end 138 of a pole section 110.

Figure 7:
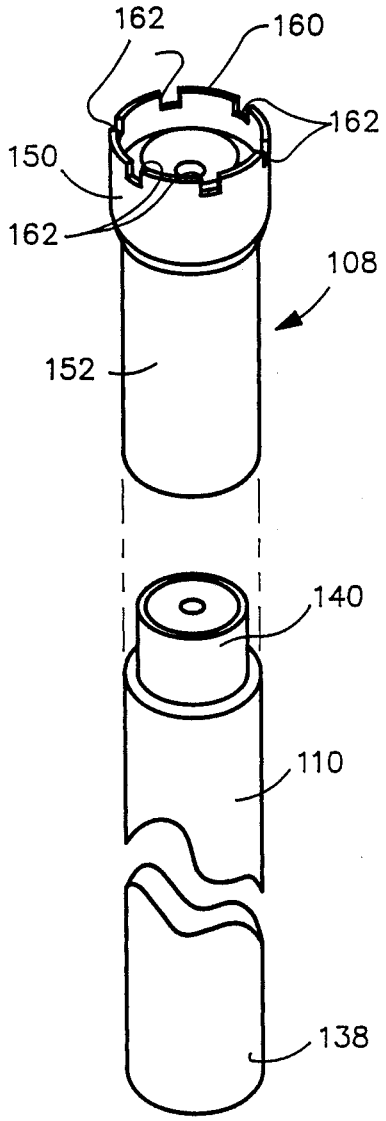
FIG. 7 is an exploded view, in perspective, of a proportion of the pole assembly according to the preferred embodiment of the present invention showing a pole section and the crown element.

As is shown in FIG. 7, each pole section 110 includes such a free end 138 and has a second free end 140 that is reduced in cross-section so that each end 140 has an exterior diameter that is the same as the interior diameter of end 138, thus allowing adjacent pole sections 110 to mate with one another. As is shown in FIG. 9, each end 140 is formed by means of a tube 142 which is inserted into and welded in place by weldments 144.

As noted, the upper end of pole assembly 100 terminates with a crown piece 108 which includes a crown element 150 and a tubular extension 152 which is sized to matably engage free end 140 of a respective pole section 110. As is shown in FIGS. 7 and 9, crown element 150 is rotatably secured to tubular extension 150. To this end, crown element 150 has a tubular shank 154 which extends through a bearing 156 so that crown element 150 is rotatably supported on bearing 156. Bearing 156, in turn, is supported by means of tubular insert 158 which is welded internally of tubular extension 152. Thus, crown element 150 may freely swivel at the upper end 106 of pole assembly 100. As is shown in FIG. 7, crown element 150 has an upper rim 160 which is provided with a plurality of equal angularly spaced notches 162 which may engage vertex portion 22 of covering 20.

Figure 8:
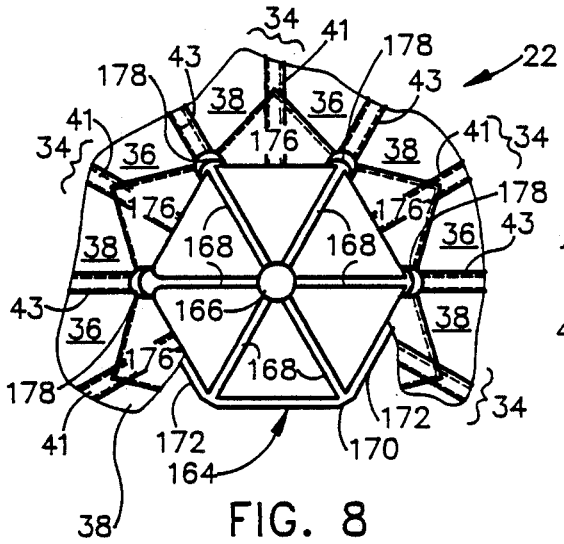
FIG. 8 is a bottom plan view, partially broken away, of the vertex portion of the covering used to create the tension fabric tent structure of the preferred embodiment of the present invention.
Figure 9:
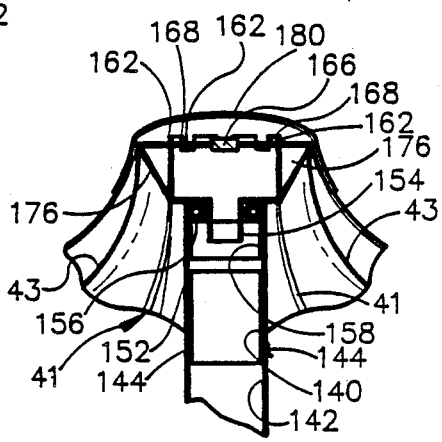
FIG. 9 is a cross-sectional view showing the engagement of the top portion and crown element of the pole assembly with the vertex portion of the covering of the present invention.

Accordingly, vertex portion 22 of covering 20 is best shown in FIGS. 8 and 9, where it may now also be seen that primary attachment seams 40 include reinforcement webbing 41 and secondary attachment seams 42 include reinforcement webbing 43. Vertex portion 22 includes a pole engaging element 164, preferably in the form of a metal spider wheel having a central hub 166, six equiangularly spaced radial spokes 168 and a hexagonal rim 170 formed by six side rods 172 so that spokes 168 terminate at vertices 174. As is shown in FIG. 8, each side panel 34 formed by a set of panel pieces 36 and 38 terminates in a reverse folded flap 176 which folds around and secures a respective side rod 172. To this end, cut out portions 178 are provided to accommodate vertices 174 of pole engaging element 164.

As may be seen in FIG. 9, when tent structure 110 is erected, spokes 168 of pole engaging element 164 engage notches 162 in crown element 150 so that vertex portion 22 is supported by crown piece 108. A vertex cap 180 is sewn to vertex portion 122 of covering 20 so that it extends over pole engaging element 164 so that it overlaps upper margins of panel sections, thus preventing ingress of rain when tent structure 10 is in the erect position. If desired, the attachment of vertex cap 180 to vertex portion 22 can leave open ports along the annular margin of vertex portion 22 to allow ventilation so that rising air may exit at vertex 16 of tent structure 10. Further, by providing the swivel means in the form of bearing 156, the assembler does not have to worry about rotational positioning of the upper end 106 of pole assembly 100 since the orientation of vertex portion 22 on pole assembly 100 will be automatic as tension is applied to erect tensioned tent structure 10.

From the foregoing, it should be understood that the present invention contemplates a method for sheltering a surface area on a support surface by use of the tensioned tent structure described above, and it should be appreciated that the general method according to the present invention is inherent in that structure. Broadly, this method includes a first step of providing a flexible covering having a vertex portion and a plurality of corner portions spaced from the vertex portion. Each corner portion is then anchored to the support surface at locations along the perimeter of the area to be sheltered. Next, a pole assembly is positioned in an upright orientation between a support surface and a vertex portion to hold the vertex portion above the support surface. Finally, the pole assembly is forcibly expanded to increase its length thereby applying upward force against the vertex portion to move the vertex portion further away from the support surface simultaneously creating tension between the vertex portion and each respective anchored corner portion so that the covering is drawn into a taut condition over the surface area to create sheltered space between a support surface and the covering.

Preferably, the broad method of the present invention is particularly adaptable wherein the covering in an erect position has the shape of a pyramid. Here, the covering has n corner portions defining a base in the shape of a regular polygon having n sides with the base corners of the pyramid located a distance r from the center of the polygon wherein n is a positive integer greater than or equal to 3. Thus, the sheltered area protected by the tent structure according to this method is in the shape of a polygon, and the method includes the step of establishing a base location for the pole assembly corresponding to the center of the polygon and wherein the step of anchoring each corner portion includes the steps of measuring a distance r radially outwardly from the center of the base location to locate a selected first anchor point and thereafter, locating successive anchor points by determining a location that is simultaneously a distance r from the base location and a distance (2 r) sin (180°/n) from a previously located anchor point.

Figure 10:
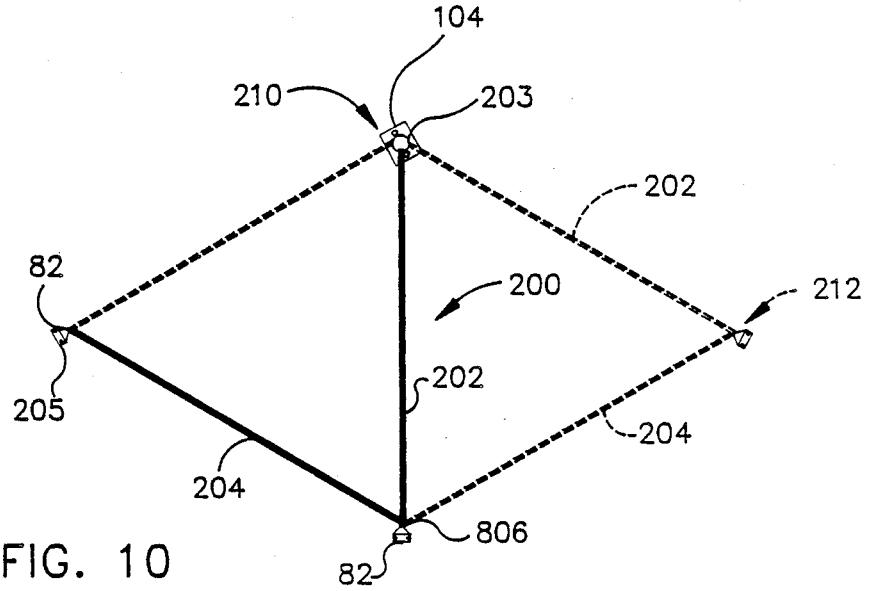
FIG. 10 is a diagrammatic view showing the location method of the anchor plates for the corner portion according to the tent structure and method according to the present invention.

A special locator device may be implemented with the preferred method, with this device shown in FIG. 10. Here, a flexible measuring cord 200 has two cord segments 202 and 204 joined at a junction point 206 so that it has opposite free ends. A first cord segment has an opposite free end 203, and the second cord segment has an opposite free end 205. Where this cord 200 is adapted to help erect a tent structure having a regular polygonal base having n sides and wherein the polygon has a distant r from a polygon vertex to the center of the polygon (wherein n is an integer greater than or equal to 3) the first cord segment 202 has a length r and the second cord segment 204 has a length equal to (2 r) sin (180°/n).

As can be seen with respect to FIG. 10, once a center pole base location is established, for example at 210 a base 104 may be mounted there. Free end 203 of segment 202 may be secured to base 104 and its length may be used to locate a first anchor point represented by a first anchor plate 82 which is affixed to the support surface. Free end 205 of segment 204 may now be held or secured to anchor plate 82 and segments 202 and 204 are simultaneously drawn taut so that junction point 206 locates a second anchor point at second anchor plate 82 prime. Free end 205 may now be released from anchor plate 82 and held or secured to anchor plate 82' and segments 202 and 204 may be drawn taut to locate a third anchor point at 212, shown in phantom. This process can be repeated until all anchor points are determined. The covering may then have its corners attached to each anchor plate, and a pole assembly may be positioned between a center pole base and the vertex of the covering and the tent structure erected, as described above.

Figure 11:
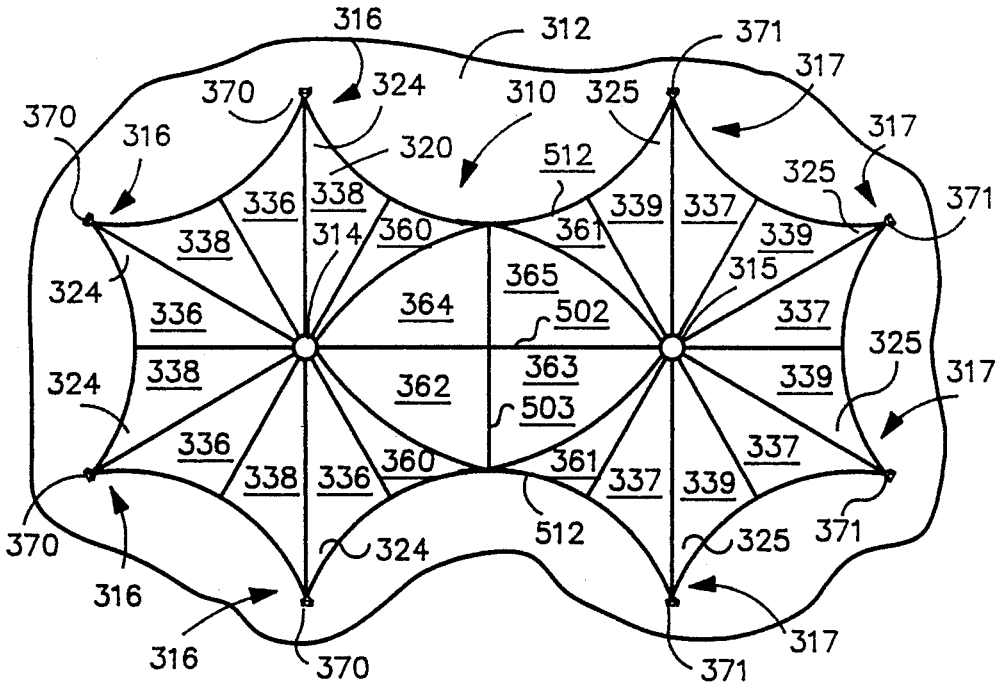
FIG. 11 is a top plan view of an alternate embodiment of the present invention showing a plurality of vertex portions to cover a larger surface area.

Although the foregoing description has been directed to a tension tent structure having a single support pole assembly, the ordinarily skilled person in this field of invention can recognize, based on the teachings of this application, that larger tent structures having multiple center poles may be created from the fundamental precepts described herein. One such example of a multiple pole assembly is shown in FIGS. 11 and 12 wherein tension tent structure 310 is shown mounted on a support surface 312 and includes a pair of vertices 314, 315 and has a first set of corners 316 and a second set of corners 317.

Figure 12:
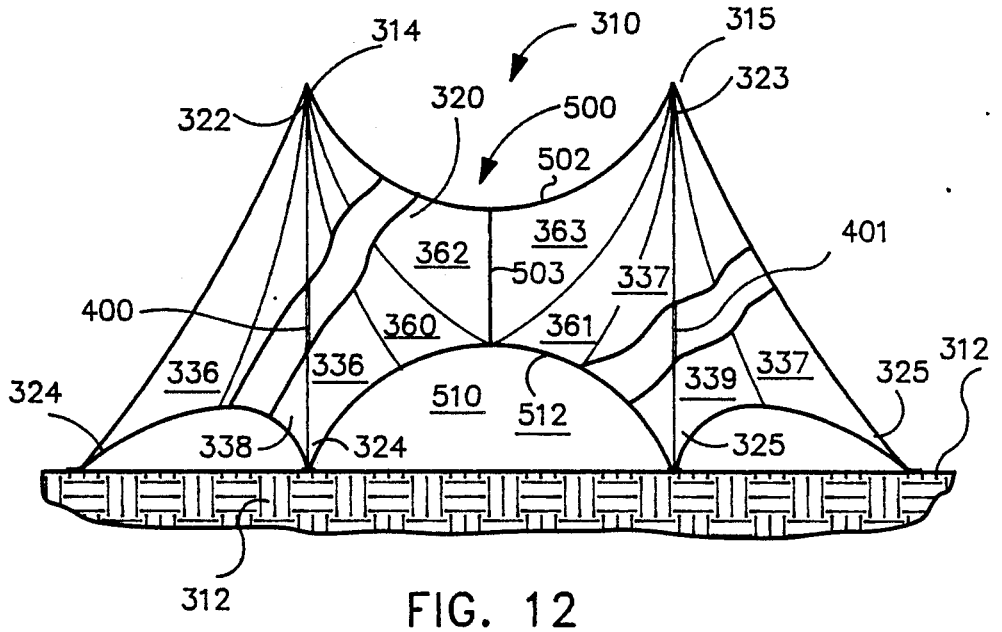
FIG. 12 is a side view in elevation, partially broken away, of the alternate embodiment of the tent structure shown in FIG. 11.

A flexible covering 320 is provided and, as is shown in FIG. 12, flexible covering 320 has a pair of vertex portions 322 and 323, a first set of corner portions 324 and a second set of corner portions 325. Corner portions 324 are each mounted by anchor members 370 while corner portions 325 are each anchored with an anchor member 371. Each of anchor members 370, 371 are preferably the same as anchor members 70, described with respect to the preferred embodiment, and include corner retaining elements and anchor plates as described above. Furthermore, each corner portion 324, 325 is preferably formed similarly to corner portion 24, shown in FIG. 4.

Vertex portions 322, 323 are formed similarly to vertex portion 22 described above, and the vertex portion 322 is supported above support surface 312 by means of a first center pole assembly 400, and vertex portion 323 is supported above support surface 312 by second center pole assembly 401. Each of pole assemblies 400, 401 are constructed similarly to pole assembly 100, described above. Outermost portions of covering 320 are formed by a plurality of generally triangular panel pieces 336, 337, 388 and 339, each of which is constructed similarly to panel pieces 36 and 38 according to the preferred embodiment. An intermediate portion of covering 320, however, is constructed differently by the use of triangular panel pieces 360, 361 and central panel pieces 362, 363, 364 and 365.

As should be readily apparent from the drawings, panel pieces 360–365 are sized so that intermediate portion 500 of covering assembly 310 is suspended between vertices 314, 315 along tension seams 502 and 503. This creates a pair of large entryways such as entryway 510 which is bounded by tension seams 512. Tension seams 326 and 327 extend between the remaining adjacent corner portions 324 and between remaining adjacent corner portions 325. Panels 360–365 are swarf-cut and bias-cut, as described above, so that intermediate portion 500 is moved into a taut condition along with the outer portions of covering 320 when center poles assemblies 400, 401 are expanded in effective lengths.

It should be appreciated from the description of the tent structure 310, that the preferred method according to the present invention may be used where a covering has a plurality of vertex portions so that a respective pole assembly is positioned in an upright position between the support surface and each respective vertex to hold a respective vertex portion above the support surface after each corner portion has been anchored. After so positioning the pole assemblies, the effective length of each pole assembly is expanded substantially at the same time to draw the covering into a taut condition.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A tent structure adapted to be erected on a support surface to provide a sheltered space, comprising:

a flexible covering including a vertex portion and a plurality of corner portions spaced from the vertex portion, said covering configured generally in the shape of a pyramid having a polygonal base with vertices defined by said corner positions, said covering constructed of a plurality of panel sections each having a pair of said edges converging at said vertex portion and an arcuate base edge, each panel section forming a face of said pyramid with said base edges forming a peripheral edge for said covering, adjacent ones of said panel sections being connected at adjacent side edges by primary attachment seams along said primary radial lines;

an anchor means for securing each corner portion to said support surface to cover a surface area thereof;

a pole assembly positionable in an right position between said support surface and said vertex portion and having an effective length which supports said covering in an erect state with said vertex portion spaced above said support surface and with said corner portions adjacent said support surface, said arcuate base edges each extending from respective corner portions adjacent said support surface to a central location above said support surface to form an archway sized to allow ingress into and egress out of said sheltered space; and extension and contraction means for adjustably varying the effective length of said pole assembly in order to move the vertex portion further from and closer to said support surface when said pole assembly is in the upright position to respectively increase and decrease tension forces between the vertex portion and the corner portions when the corner portions are anchored to the support surface whereby the covering is held taut when tension is applied to the vertex portion by the pole assembly so that the tent structure is thereby erected.

2. A tent structure according to claim 1 wherein each said archway is provided with a screen panel secured along the base edge of its associated panel section and dimensioned to extend between the base edge and said support surface.

3. A tent structure according to claim 2 wherein at least one screen panel is provided with a door opening therethrough.

4. A tent structure according to claim 3 wherein each said screen panel is provided with a coating operative to restrict a person's ability to see into the sheltered space while permitting a person to see out of the sheltered space.

5. A tent structure according to claim 1 wherein said pole assembly is formed of a plurality of pole sections mountable to one another in end-to-end relation.

6. A tent structure according to claim 1 wherein each panel section is formed by a plurality of triangular panel pieces, adjacent ones of said panel pieces being connected at secondary attachment seams along secondary radial lines extending from said vertex portion to said peripheral edge.

7. A tent structure according to claim 6 wherein said covering is constructed of a woven fabric material which has a set of warp threads and a set of weft threads and wherein each panel section has side edge forming panel pieces oriented such one of the sets of warp and weft thread are parallel to its primary attachment seam.

8. A tent structure according to claim 7 wherein the base edge of each panel section is bias-cut whereby each panel section may stretch in a direction transverse to said primary radial lines, said panel piece configured such that the secondary attachment seams and the bias-cut base edges apply tension forces along said peripheral edge whereby said panel pieces are held taut when said pole assembly applies tension to said vertex portion.

9. A tent structure according to claim 1 wherein said polygonal base is a regular polygon, said primary radial lines being equiangularly spaced around said vertex.

10. A tent structure according to claim 9 wherein said polygon is a hexagon.

11. A tent structure according to claim 1 wherein said covering including a plurality of vertex portions and including a plurality of said pole assemblies, there being a pole assembly associated with each said vertex portion, said pole assemblies cooperating with one another to apply tension to said corner portions and to portions of said covering between said vertex portions whereby said covering is held taut.

12. A tent structure according to claim 1 wherein each said anchor means includes a anchor plate engaging said support surface and anchor stake means for securing the anchor plate to the support surface.

13. A tent structure according to claim 12 wherein each corner portion terminates in a reverse folded corner flap secured to form a corner sleeve, each said corner sleeve receivably mounting a corner fastener, each said corner fastener operative to releasably engage a respective anchor plate.

14. A tent structure according to claim 13 wherein each corner portion includes a reinforcement insert secured thereto and reverse curve fold with said corner flap to mount said corner fastener.

15. A tent structure adapted to be erected on a support surface to provide a sheltered space, comprising:

a flexible covering including a vertex portion and a plurality of corner portions spaced from the vertex portion, said covering congigured in a selected geometrical shape having a peripheral edge and constructed of a plurality of generally triangular panel sections, each said panel section having a pair of side edges and a base edge and adjacent ones of said panel sections being connected at adjacent side edges to define primary attachment seams extending from the vertex portion to a respective corner portion, each said panel section formed by a plurality of triangular panel pieces constructed of a woven fabric material having a set of wrap threads and a set of weft threads, adjacent ones of said panel pieces being connected along secondary attachment seams such that each panel section has side edge forming panel pieces oriented so that one of the sets of warp and weft threads is parallel to each respective primary attachment seams, the base edge of each said panel section being bias-cut whereby each said panel section may stretch in a direction transverse to its respective primary attachment seams;

an anchor means for securing each corner portion to said support surface to cover a surface area thereof; and a pole assembly positionable in an upright position between said support surface and said vertex portion and having an effective length which supports said covering in an erect state with said vertex portion spaced above said support surface, said pole assembly including extension and contraction means for adjustably varying the effective length thereof in order to move the vertex portion further from and closer to said support surface when said pole assembly is in the upright position to resepectively increase and decrease tension forces between the vertex portion and the corner portions when the corner portions are anchored to the support surface whereby the covering is held taut along primary radial lines corresponding to said primary attachment seams when tension is applied to the vertex portion by the pole assembly so that the tent structure is thereby erected with the secondary attachment seams and the bias-cut base edges applying tension forces along said peripheral edge whereby said panel pieces are held taut when said pole assembly applies tension to said vertex portion.

16. A tent structure according to claim 15 wherein said covering including a plurality of vertex portions and including a plurality of said pole assemblies, there being a pole assembly associated with each said vertex portion, said pole assemblies cooperating with one another to apply tension to said corner portions and to portions of said covering between said vertex portions whereby said covering is held taut.

17. A tent structure according to claim 15 wherein said covering is generally in the shape of a pyramid having a polygonal base with vertices defined by said corner portions when in the erect state.

18. A tent structure according to claim 17 wherein each said panel section forms a face of said pyramid with said base edges forming a peripheral edge for said covering.

19. A tent structure according to claim 18 wherein the base edge of at least one of said panel sections forms an archway dimensioned sufficiently to allow ingress into and egress out of said sheltered space.

20. A tent structure according to claim 18 including first reinforcement webbing strips attached to each pair of adjacent panel sections along the respective primary attachment seam.

21. A tent structure according to claim 20 including edge reinforcement webbing strips attached to each base edge along said peripheral edge.

22. A tent structure according to claim 15 wherein said vertex portion of said covering includes a pole engaging element operative to engage an upper end of said pole assembly.

23. A tent structure according to claim 22 wherein said pole engaging element includes a hub, a rim and a plurality of spokes extending radially from said hub to said rim, the upper end of said pole assembly including means for engaging said spokes.

24. A tent structure according to claim 23 including swivel means for permitting rotation of the upper end of the pole assembly.

25. A tent structure according to claim 23 wherein said covering is generally in the shape of a pyramid having a polygonal base with vertices defined by said corner portions when in the erect state such that the tension forces between the vertex portion and each corner portion are along primary radial lines extending there between, and wherein said covering is constructed of a plurality of panel sections each having a pair of side edges and a base edge, each panel section forming a face of said pyramid with said base edges forming a peripheral edge for said covering, adjacent ones of said panel sections being connected at adjacent side edges by primary attachment seams along said primary radial lines, each panel section terminating at the vertex portion in a reverse folded flap secured to form a sleeve receiving a portion of said rim.

26. A tent structure according to claim 25 wherein said covering includes a vertex cap extending over said pole engaging element and overlapping upper margins of said panel sections.

27. A tent structure adapted to be erected on a support surface to provide a sheltered space, comprising:

a flexible covering including a vertex portion and a plurality of corner portions spaced from the vertex portion, said covering configured in a selected geometrical shape;

an anchor means for securing each corner portion to said support surface to cover a surface area thereof;

a pole assembly positionable in an upright position between said support surface and said vertex portion and having an effective length which supports said covering in an erect state with said vertex portion spaced above said support surface said pole assembly constructed of a plurality of pole sections mountable together, at least one of said pole sections formed by an outer tubular member and an inner telescoping member which telescopes into and out of said outer tubular member; and extension and contraction means mounted internally of said outer tubular member and enclosed thereby for driveably engaging said inner telescoping member to adjustably vary the effective length of said pole assembly in order to move the vertex position of said covering further from and closer to said support surface when said pole assembly is in the upright position to respectively increase and decrease tension forces between the vertex portion and the corner portions when the corner portions are anchored to the support surface whereby the covering is held taut when tension is applied to the vertex portion by the pole assembly so that the tent structure is thereby erected.

28. A tent structure according to claim 27 wherein said extension and contraction means includes a rack gear and a gear drive assembly therefor whereby said outer tubular member and said inner telescoping member may be telescopically driven with respect to one another.

29. A tent structure according to claim 27 including a pole mounting element having a flat plate engaging said support surface, a pole receiving structure upwardly extending from said flat plate and pole stake means for securing the flat plate to said support surface.

30. A tent structure according to claim 27 wherein said covering including a plurality of vertex portions and including a plurality of said pole assemblies, there being a pole assembly associated with each said vertex portion, said pole assemblies cooperating with one another to apply tension to said corner portions and to portions of said covering between said vertex portions whereby said covering is held taut.

* * * * *